US006827429B2

(12) United States Patent
Jeanmaire et al.

(10) Patent No.: US 6,827,429 B2
(45) Date of Patent: Dec. 7, 2004

(54) CONTINUOUS INK JET PRINTING METHOD AND APPARATUS WITH INK DROPLET VELOCITY DISCRIMINATION

(75) Inventors: David L. Jeanmaire, Brockport, NY (US); David P. Trauernicht, Rochester, NY (US); James M. Chwalek, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 243 days.

(21) Appl. No.: 09/969,679

(22) Filed: Oct. 3, 2001

(65) Prior Publication Data

US 2003/0063166 A1 Apr. 3, 2003

(51) Int. Cl.[7] ..... B41J 2/09
(52) U.S. Cl. ..... 347/77
(58) Field of Search ..... 347/77, 41, 76, 347/65, 78, 19, 82, 56, 73, 74, 75, 90, 15, 20, 12, 40; 438/21; 216/27; 209/638, 639; 228/102; 366/162.4

(56) References Cited

U.S. PATENT DOCUMENTS

| | | | | | |
|---|---|---|---|---|---|
| 1,941,001 | A | | 12/1933 | Hansell | 178/96 |
| 3,373,437 | A | | 3/1968 | Sweet et al. | 347/74 |
| 3,416,153 | A | | 12/1968 | Hertz et al. | 347/73 |
| 3,709,432 | A | | 1/1973 | Robertson | 239/4 |
| 3,878,519 | A | | 4/1975 | Eaton | 347/75 |
| 4,091,390 | A | * | 5/1978 | Smith et al. | 347/41 |
| 4,190,844 | A | | 2/1980 | Taylor | 347/82 |
| 4,346,387 | A | * | 8/1982 | Hertz | 347/75 |
| 4,638,382 | A | | 1/1987 | Sochor | 360/68 |
| 4,914,522 | A | | 4/1990 | Duffield et al. | 358/296 |
| 5,224,843 | A | | 7/1993 | vanLintel | 417/413.2 |
| 5,325,112 | A | * | 6/1994 | Muto | 347/19 |
| 5,621,443 | A | * | 4/1997 | Buschulte et al. | 347/73 |
| 5,938,102 | A | * | 8/1999 | Muntz et al. | 228/102 |
| 6,079,821 | A | | 6/2000 | Chwalek et al. | 347/82 |
| 6,200,013 | B1 | * | 3/2001 | Takeuchi et al. | 366/162.4 |

* cited by examiner

*Primary Examiner*—K. Feggins
(74) *Attorney, Agent, or Firm*—Milton S. Sales; Mark G. Bocchetti

(57) ABSTRACT

An apparatus for printing an image is provided. In this apparatus, each nozzle is operable to selectively create a stream of ink droplets having a plurality of velocities. The apparatus also includes a droplet deflector having a gas source. The gas source is positioned at an angle with respect to the stream of ink droplets and is operable to interact with the stream of ink droplets thereby separating ink droplets into printing and non-printing paths.

11 Claims, 3 Drawing Sheets

CONTINUOUS INK JET PRINTING METHOD AND APPARATUS WITH INK DROPLET VELOCITY DISCRIMINATION

CROSS REFERENCE TO RELATED APPLICATIONS

Reference is made to commonly assigned, co-pending U.S. patent applications Ser. No. 09/750,946, filed in the names of David L. Jeanmaire et al. on Dec. 28, 2000; Ser. No. 09/861,692 filed in the name of David L. Jeanmaire on May 21, 2001; Ser. No. 09/892,831 filed in the name of David L. Jeanmaire on Jun. 27, 2001; and Ser. No. 09/910,405 filed in the name of David L. Jeanmaire on Jul. 20, 2001.

FIELD OF THE INVENTION

This invention relates generally to the field of digitally controlled printing devices, and in particular to continuous ink jet printers wherein a liquid ink stream breaks into droplets, some of which are selectively deflected.

BACKGROUND OF THE INVENTION

Traditionally, digitally controlled color ink jet printing capability is accomplished by one of two technologies. Both require independent ink supplies for each of the colors of ink provided. Ink is fed through channels formed in the print head. Each channel includes a nozzle from which droplets of ink are selectively extruded and deposited upon a receiving medium. Typically, each technology requires separate ink delivery systems for each ink color used in printing. Ordinarily, the three primary subtractive colors, i.e. cyan, yellow and magenta, are used because these colors can produce, in general, up to several million perceived color combinations.

The first technology, commonly referred to as "drop-on-demand" ink jet printing, typically provides ink droplets for impact upon a recording surface using a pressurization actuator (themal, piezoelectric, etc.). Selective activation of the actuator causes the formation and ejection of a flying ink droplet that crosses the space between the print head and the print media and strikes the print media The formation of printed images is achieved by controlling the individual formation of ink droplets, as is required to create the desired image. Typically, a slight negative pressure within each channel keeps the ink from inadvertently escaping through the nozzle, and also forms a slightly concave meniscus at the nozzle, thus helping to keep the nozzle clean.

With thermal actuators, a heater, located at a convenient location, heats the ink causing a quantity of ink to phase change into a gaseous steam bubble. This increases the internal ink pressure sufficiently for an ink droplet to be expelled. The bubble then collapses as the heating element cools, and the resulting vacuum draws fluid from a reservoir to replace ink that was ejected from the nozzle.

Piezoelectric actuators, such as that disclosed in U.S. Pat. No. 5,224,843, issued to vanLintel, on Jul. 6, 1993, have a piezoelectric crystal in an ink fluid channel that flexes when an electric current flows through it forcing an ink droplet out of a nozzle. The most commonly produced piezoelectric materials are ceramics, such as lead zirconate titanate, barium titanate, lead titanate, and lead metaniobate.

In U.S. Pat. No. 4,914,522, which issued to Duffield et al. on Apr. 3, 1990, a drop-on-demand ink jet printer utilizes air pressure to produce a desired color density in a printed image. Ink in a reservoir travels through a conduit and forms a meniscus at an end of an ink nozzle. An air nozzle, positioned so that a stream of air flows across the meniscus at the end of the nozzle, causes the ink to be extracted from the nozzle and atomized into a fine spray. The stream of air is applied for controllable time periods at a constant pressure through a conduit to a control valve. The ink dot size on the image remains constant while the desired color density of the ink dot is varied depending on the pulse width of the air stream.

The second technology, commonly referred to as "continuous stream" or "continuous" ink jet printing, uses a pressurized ink source that produces a continuous stream of ink droplets. Conventional continuous inkjet printers utilize electrostatic charging devices that are placed close to the point where a filament of ink breaks into individual ink droplets. The ink droplets are electrically charged and then directed to an appropriate location by deflection electrodes. When no print is desired, the ink droplets are directed into an ink-capturing mechanism (often referred to as catcher, interceptor, or gutter). When print is desired, the ink droplets are directed to strike a print media Typically, continuous ink jet printing devices are faster than drop-on-demand devices and produce higher quality printed images and graphics. However, each color printed requires an individual droplet formation, deflection, and capturing system.

U.S. Pat. No. 1,941,001, issued to Hansell on Dec. 26, 1933, and U.S. Pat. No. 3,373,437 issued to Sweet et al. on Mar. 12, 1968, each disclose an-array of continuous ink jet nozzles wherein ink droplets to be printed are selectively charged and deflected towards the recording medium. This technique is known as binary deflection continuous ink jet.

U.S. Pat. No. 3,416,153, issued to Hertz et al. on Oct. 6, 1963, discloses a method of achieving variable optical density of printed spots in continuous ink jet printing using the electrostatic dispersion of a charged droplet stream to modulate the number of droplets which pass through a small aperture.

U.S. Pat. No. 3,878,519, issued to Eaton on Apr. 15, 1975, discloses a method and apparatus for synchronizing droplet formation in a liquid stream using electrostatic deflection by a charging tunnel and deflection plates.

U.S. Pat. No. 4,346,387, issued to Hertz on Aug. 24, 1982, discloses a method and apparatus for controlling the electric charge on droplets formed by the breaking up of a pressurized liquid stream at a droplet formation point located within the electric field having an electric potential gradient. Droplet formation is effected at a point in the field corresponding to the desired predetermined charge to be placed on the droplets at the point of their formation. In addition to charging tunnels, deflection plates are used to actually deflect droplets.

U.S. Pat. No. 4,638,382, issued to Drake et al. on Jan. 20, 1987, discloses a continuous ink jet print head that utilizes constant thermal pulses to agitate ink streams admitted through a plurality of nozzles in order to break up the ink streams into droplets at a fixed distance from the nozzles. At this point, the droplets are individually charged by a charging electrode and then deflected using deflection plates positioned the droplet path.

As conventional continuous ink jet printers utilize electrostatic charging devices and deflector plates, they require many components and large spatial volumes in which to operate. This results in continuous ink jet print heads and printers that are complicated, have high energy requirements, are difficult to manufacture, and are difficult to control.

U.S. Pat. No. 3,709,432, issued to Robertson on Jan. 9, 1973, discloses a method and apparatus for stimulating a filament of working fluid causing the working fluid to break up into uniformly spaced ink droplets through the use of transducers. The lengths of the filaments before they break up into ink droplets are regulated by controlling the stimulation energy supplied to the transducers, with high amplitude stimulation resulting in short filaments and low amplitude stimulations resulting in longer filaments. A flow of air is generated across the paths of the fluid at a point intermediate to the ends of the long and short filaments. The air flow affects the trajectories of the filaments before they break up into droplets more than it affects the trajectories of the ink droplets themselves. By controlling the lengths of the filaments, the trajectories of the ink droplets can be controlled, or switched from one path to another. As such, some ink droplets may be directed into a catcher while allowing other ink droplets to be applied to a receiving member.

While this method does not rely on electrostatic means to affect the trajectory of droplets, it does rely on the precise control of the break up points of the filaments and the placement of the air flow intermediate to these break up points. Such a system is difficult to control and to manufacture. Furthermore, the physical separation or amount of discrimination between the two droplet paths is small, further adding to the difficulty of control and manufacture.

U.S. Pat. No. 4,190,844, issued to Taylor on Feb. 26, 1980, discloses a continuous ink jet printer having a first pneumatic deflector for deflecting non-printed ink droplets to a catcher and a second pneumatic deflector for oscillating printed ink droplets. A print head supplies a filament of working fluid that breaks into individual ink droplets. The ink droplets are then selectively deflected by a first pneumatic deflector, a second pneumatic deflector, or both. The first pneumatic deflector is an "on/off" type having a diaphragm that either opens or closes a nozzle depending on one of two distinct electrical signals received from a central control unit. This determines whether the ink droplet is to be printed or non-printed. The second pneumatic deflector is a continuous type having a diaphragm that varies the amount that a nozzle is open, depending on a varying electrical signal received the central control unit. This oscillates printed ink droplets so that characters may be printed one character at a time. If only the first pneumatic deflector is used, characters are created one line at a time, being built up by repeated traverses of the print head.

While this method does not rely on electrostatic means to affect the trajectory of droplets, it does rely on the precise control and timing of the first ("ON/OFF") pneumatic deflector to create printed and non-printed ink droplets. Such a system is difficult to manufacture and accurately control, resulting in at least the ink droplet build up discussed above. Furthermore, the physical separation or amount of discrimination between the two droplet paths is erratic due to the precise timing requirements, increasing the difficulty of controlling printed and non-printed ink droplets and resulting in poor ink droplet trajectory control.

Additionally, using two pneumatic deflectors complicates construction of the print head and requires more components. The additional components and complicated structure require large spatial volumes between the print head and the media, increasing the ink droplet trajectory distance. Increasing the distance of the droplet trajectory decreases droplet placement accuracy and affects the print image quality. Again, there is a need to minimize the distance that the droplet must travel before striking the print media in order to insure high quality images.

U.S. Pat. No. 6,079,821, issued to Chwalek et al. on Jun. 27, 2000, discloses a continuous ink jet printer that uses actuation of asymmetric heaters to create individual ink droplets from a filament of working fluid and to deflect those ink droplets. A print head includes a pressurized ink source and an asymmetric heater operable to form printed ink droplets and non-printed ink droplets. Printed ink droplets flow along a printed ink droplet path ultimately striking a receiving medium, while non-printed ink droplets flow along a non-printed ink droplet path ultimately striking a catcher surface. Non-printed ink droplets are recycled or disposed of through an ink removal channel formed in the catcher. While the ink jet printer disclosed in Chwalek et al. works extremely well for its intended purpose, it is best adapted for use with inks that have a large viscosity change with temperature.

Each of the above-described inkjet printing systems has advantages and disadvantages. However, print heads which are low-power and low-voltage in operation will be advantaged in the marketplace, especially in page-width arrays. U.S. Pat. No. 3,709,432, issued to J. Robertson on Jan. 9, 1973, discloses continuous-jet printing wherein nozzle transducers are selectively actuated at a plurality of activation powers to vary the breakup length of ink filaments extruded from the nozzles. A gas stream provides a force that displaces the filaments more before they breakup into droplets, than the droplets themselves. Thus ink droplets can be separated into printing and non-printing paths according to transducer power. While this process consumes only moderate power, and is compatible with a wide range of inks, the gas flow, when directed in the region of droplet breakoff, interferes with droplet formation in such a way that ink droplets of varying volumes are created along both printing and non-printing paths. In particular, the droplets selected for printing then are deflected along somewhat different paths according to variations in volume, thus resulting in poor droplet placement on the print media, and consequently low image quality results.

Therefore, it can be seen that there is an opportunity to provide an improvement to continuous ink jet printers that use a gas flow for droplet separation, by providing a mechanism to generate droplets of constant volume. Low-power and low-voltage print head operation are achieved, while providing for quality consistent with the printing of photographic images.

SUMMARY OF THE INVENTION

An object of the present invention is to provide for improved droplet placement in printers with print heads in which heat pulses are used to break up fluid into droplets, and which use a gas flow to separate the droplets along printing and non-printing paths. The improved registration of printed droplets improves the quality of the image on the receiver media.

According to a feature of the present invention, print head includes one or more nozzles from which a stream of ink droplets is emitted. A mechanism, associated with each nozzle, is adapted to independently adjust the velocity of the ink droplets emitted by the associated nozzle. The mechanism has a first state wherein the velocities of the droplets emitted from the nozzles are within a first range of velocities, and a second state wherein the velocities of the droplets emitted from the nozzles are within a second range of velocities, wherein velocities within the second range are greater than velocities within the first range. Droplet selection apparatus is provided adapted to cause ink droplets within the first range of velocities to move along a first path, and ink droplets within the second range of velocities to move along a second path.

According to a feature of the present invention, print head includes one or more nozzles from which a stream of ink droplets is emitted. A mechanism, associated with each nozzle, is adapted to independently adjust the velocity of the ink droplets emitted by the associated nozzle. The mechanism has a first state wherein the velocities of the droplets emitted from the nozzles are within a first range of velocities, and a second state wherein the velocities of the droplets emitted from the nozzles are within a second range of velocities, wherein velocities within the second range are greater than velocities within the first range. Droplet selection apparatus is provided adapted to cause ink droplets within the first range of velocities to move along a first path, and ink droplets within the second range of velocities to move along a second path. An ink catcher positioned to allow droplets moving along said first path to move unobstructed past the catcher, while intercepting droplets moving along said second path.

BRIEF DESCRIPTION OF THE DRAWINGS

Other features and advantages of the present invention will become apparent from the following description of the preferred embodiments of the invention and the accompanying drawings, wherein.

DETAILED DESCRIPTION OF THE INVENTION

Figure 1:
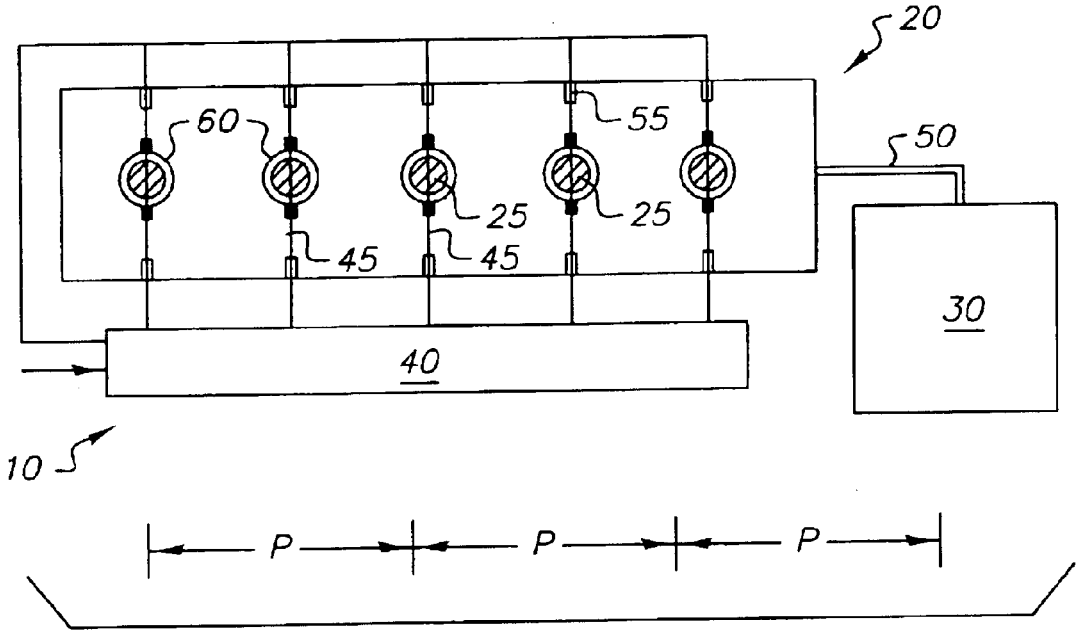
FIG. 1 is a schematic plan view of a print head made in accordance with a preferred embodiment of the present invention.

The present description will be directed in particular to elements forming part of, or cooperating more directly with, apparatus in accordance with the present invention. It is to be understood that elements not specifically shown or described may take various forms well known to those skilled in the art.

With reference to FIG. 1 through FIG. 4, like reference numerals designate like components throughout all of the figures.

FIG. 1 shows an ink droplet forming mechanism 10 of a preferred embodiment of the present invention, including a print bead 20, at least one ink supply 30, and a controller 40. Although ink droplet forming mechanism 10 is illustrated schematically and not to scale for the sake of clarity, one of ordinary skill in the art will be able to readily determine the specific size and interconnections of the elements of a practical apparatus according to a specific desired application.

In a preferred embodiment of the present invention, print head 20 is formed from a semiconductor material, such as for example silicon, using known semiconductor fabrication techniques (CMOS circuit fabrication techniques, micro-electro mechanical structure (MEMS) fabrication techniques, etc.). However, print head 20 may be formed from any materials using any fabrication techniques conventionally known in the art.

As illustrated in FIG. 1, a row of nozzles is formed on print head 20. Nozzles 25 are in fluid communication with ink supply 30 through ink passage 50, also formed in print head 20. Single color printing, such as so-called black and white, may be accomplished using a single-ink supply 30 and a single set of nozzles 25. In order to provide color printing using two or more ink colors, print head 20 may incorporate additional ink supplies in the manner of supply 30 and corresponding sets of nozzles 25.

A set of heaters 60 is at least partially formed or positioned on print head 20 around corresponding nozzles 25. Although heaters 60 may be disposed radially away from the edge of corresponding nozzles 25, they are preferably disposed close to corresponding nozzles 25 in a concentric manner. In a preferred embodiment, heaters 60 are formed in a substantially circular or ring shape. However, heaters 60 may be formed in a partial ring, square, etc. Heaters 60 in a preferred embodiment consist principally of an electric resistive heating element electrically connected to electrical contact pads 55 via conductors 45.

Conductors 45 and electrical contact pads 55 may be at least partially formed or positioned on print head 20 to provide an electrical connection between controller 40 and heaters 60. Alternatively, the electrical connection between controller 40 and heaters 60 may be accomplished in any well-known manner. Controller 40 is typically a logic controller, programmable microprocessor, etc. operable to control many components (heaters 60, ink droplet forming mechanism 10, etc.) in a desired manner.

Figure 2:
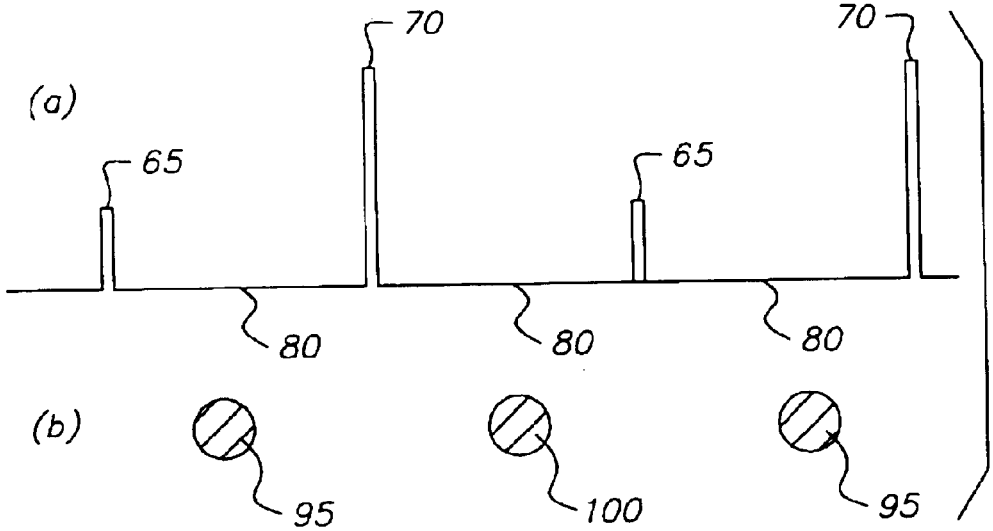
FIG. 2 is a diagram illustrating a frequency control of a heater as described in said embodiment of the present invention.

FIG. 2 is a schematic example of the electrical activation waveform provided by controller 40 to heaters 60. In general, pulsing of heaters 60 at high power levels forms ink droplets moving at higher velocity, while pulsing at lower powers creates droplets moving at slower velocity. In the first example presented here, the faster moving ink droplets are to be used for marking the image receiver, while slower, non-printing droplets are captured for ink recycling.

In this example, a single droplet per nozzle per image pixel is created. Period P is the time associated with the printing of an associated image pixel. The schematic illustration shows that droplets of constant volume are created continuously as a result of the application of the waveforms of heater activation, and essentially independently of pulse amplitude.

In the droplet formation for a non-printing image pixel, a droplet 95 is created using a lower power electrical pulse 65 and a delay time 80. In the case of a printing image pixel, droplet 100 is created with a higher power pulse 70 and a delay time 80. As a result of the higher power of heater activation, printing droplets 100 have a higher velocity than non-printing droplets 95.

Figure 3:
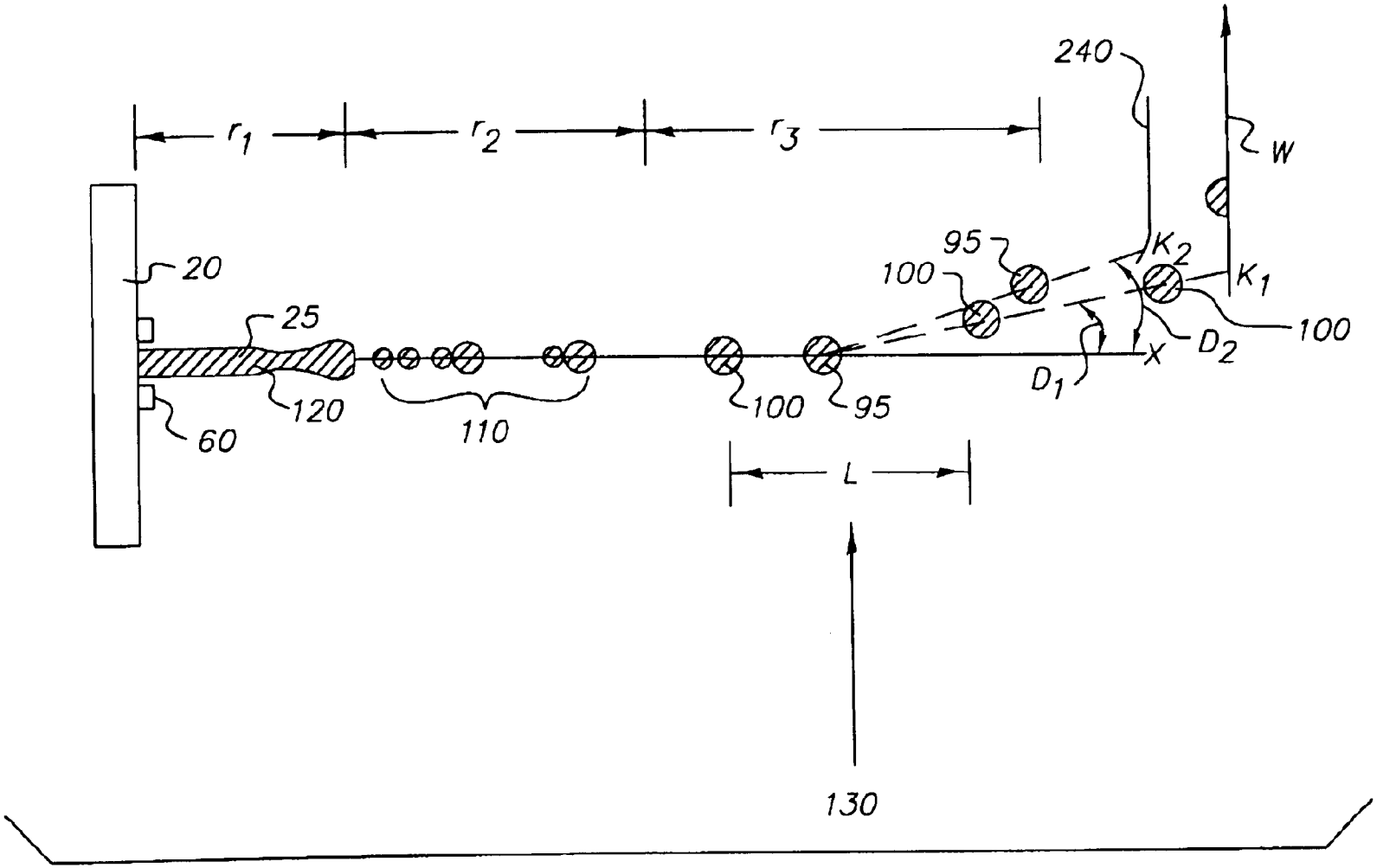
FIG. 3 is a cross-sectional view of an inkjet print head made in accordance with said embodiment of the present invention.

Referring to FIG. 3, print head 20, which is adapted to provide printing droplets of a first velocity and non-printing droplets of a second velocity, is coupled with a droplet deflector adapted to produce a force on the droplets. In the illustrated embodiment, a gas-flow discrimination means separates droplets into printing or non-printing paths according to droplet velocity. Ink is ejected through nozzles 25 in print head 20, creating a filament of working fluid 120 moving substantially perpendicular to print head 20 along axis X. The physical region over which the filament of working fluid is intact is designated as $r_1$. Heaters 60 are selectively activated at various powers according to image data, causing filaments of working fluid 120 to break up into streams of individual ink droplets. Coalescence of initial droplets 10 occurs in forming both printing droplets 100 and non-printing droplets 95. This region of jet break-up and droplet coalescence is designated as $r_2$.

Following region $r_2$, droplet formation is complete in a region $r_3$, and faster moving printing droplets and slower moving, non-printing droplets are spatially separated. A discrimination force 130 is provided by a gas flow at a non-zero angle with respect to axis X. For example, the gas flow may be perpendicular to axis X. Discrimination force 130 acts over distance L, which is less than or equal to distance $r_3$. Lower velocity, non-printing droplets 95 have a greater interaction time with force 130 than do faster moving droplets 100. As a result, droplets 95 and droplets 100 separate into two paths with gas force 130 deflecting droplets 95 more than droplets 100. The gas flow rate can be adjusted to provide sufficient deviation $D_1$ between the fast droplet path $K_1$ and the slower droplet path $K_2$. This permits faster moving droplets 100 to strike print media W while slower moving, non-printing droplets 95 are captured by a ink guttering structure 240 described below.

As an example, an aqueous ink is formulated to contain 40% by weight of dipropylene glycol monomethyl ether (DOW Chemical). This results in an ink fluid that exhibits a significant reduction in viscosity with temperature. In the waveform of FIG. 2, pulse 65 is 1 microsecond in duration and dissipates 10 microjoules of power in heater 60, while pulse 70 is 1 microsecond in duration and dissipates 50 microjoules of power in heater 60. Alternatively, the amplitudes of pulse 95 and pulse 100 could be held constant and the width varied to give an equivalent result amplitudes of Delay time 80 is 50 microseconds. The ink pressure in supply 30 is adjusted to give droplets 95 a velocity of 6.5 m/sec. As a result of the heat generated from pulse 70 droplets 100 have a 5% higher velocity than droplets 95. Consequently, deviation $D_1$ and deviation $D_2$ differ by the square of the velocity ratio, or by 10% in this example.

Delay time 80 can be adjusted to create droplets 95 and droplets 100 of different volumes, however, shorter times will decrease the overall separation of droplets 95 and droplets 100. If this separation is too small, the velocity increase of droplets 100 relative to droplets 95 will cause droplets 100 to overtake and merge with droplets 95 before separation force 130 directs droplets 95 and droplets 100 along different paths, and proper printing operation will be lost.

Figure 4:
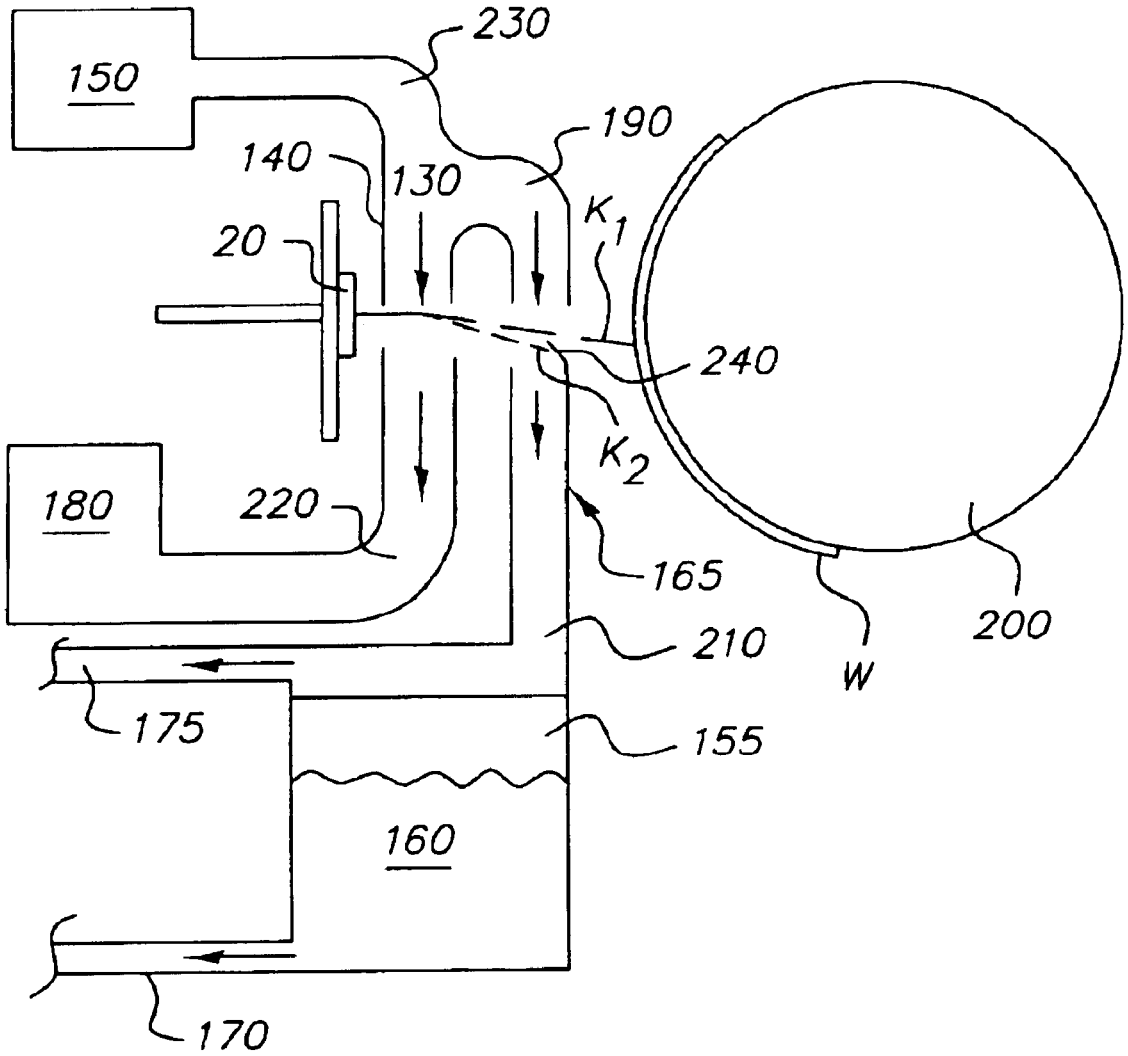
FIG. 4 is a schematic view of an ink jet printer made in accordance with said embodiment of the present invention.

Referring to FIG. 4, a printing apparatus (typically, an ink jet printer or print head) includes a print head here containing a row of nozzles 25. Greater velocity ink droplets 100 and lower velocity ink droplets 95 are formed from ink ejected in streams from print head 20 substantially along ejection path X. A droplet deflector 140 contains upper plenum 230 and lower plenum 220, which facilitate a laminar flow of gas in droplet deflector 140. Pressurized air from pump 150 enters upper plenum 230 which is disposed opposite plenum 220 and promotes laminar gas flow while protecting the droplet stream moving along path X from external air disturbances. The application of force 130 due to gas flow separates the ink droplets into fast-droplet path $K_1$ and slow-droplet path $K_2$.

An ink collection structure 165, disposed adjacent to plenum 220 near path X, intercepts path $K_2$ of lower velocity droplets 95, while allowing higher velocity ink droplets 100, traveling along path $K_2$ to continue on to the recording media W carried by print drum 200.

Slower, non-printing ink droplets 95 strike ink catcher 240 in ink collection structure 165. Ink recovery conduit 210 communicates with recovery reservoir 160 to facilitate recovery of non-printed ink droplets by an ink return line 170 for subsequent reuse. A vacuum conduit 175, coupled to negative pressure source 180 can communicate with ink recovery reservoir 160 to create a negative pressure in ink recovery conduit 210 improving ink droplet separation and ink droplet removal as discussed above. The pressure reduction in conduit 210 is sufficient to draw in recovered ink, however it is not large enough to cause significant air flow to substantially alter droplet path $K_1$. Ink recovery reservoir contains open-cell sponge or foam 155, which prevents ink sloshing in applications where the print head 20 is rapidly scanned.

A small portion of the gas flowing through upper plenum 230 is re-directed by plenum 190 to the entrance of ink recovery conduit 210. The gas pressure in droplet deflector 140 is adjusted in combination with the design of plenum 220 and 230 so that the gas pressure in the print head assembly near ink catcher 240 is positive with respect to the ambient air pressure near print drum 200. Environmental dust and paper fibers are thusly discouraged from approaching and adhering to ink catcher 240 and are additionally excluded from entering ink recovery conduit 210.

In operation, a recording media W is transported in a direction transverse to axis X by print drum 200 in a known manner. Transport of recording media W is coordinated with movement of print mechanism 10 and/or movement of print head 20. In addition, this can be accomplished using controller 40 in a known manner. Recording media W may be selected from a wide variety of materials including paper, vinyl, cloth, other fibrous materials, etc.

While the foregoing description includes many details and specificities, it is to be understood that these have been included for purposes of explanation only, and are not to be interpreted as limitations of the present invention. Many modifications to the embodiments described above can be made without departing from the spirit and scope of the invention, as is intended to be encompassed by the following claims and their legal equivalents.

What is claimed is:

1. A print head for printing an image, said print head comprising:

one or more nozzles from which a stream of ink droplets is emitted, the stream of ink droplets emitted along a nozzle axis, the droplets having adjustable ink velocities;

a mechanism, associated with each nozzle, adapted to independently adjust the velocity of the ink droplets emitted by the associated nozzle, said mechanism having:

a first state wherein the velocities of the droplets emitted from the nozzles are within a first range of velocities, and a second state wherein the velocities of the droplets emitted from the nozzles are within a second range of velocities, wherein velocities within said second range are greater than velocities within said first range; and a gas flow directed to intersect the nozzle axis to cause:

ink droplets within said first range of velocities to move along a first path, and ink droplets within said second range of velocities to move along a second path.

2. An apparatus as set forth in claim 1 wherein the gas flow is generally perpendicular to the nozzle axis.

3. A print head as set forth in claim 1 wherein the gas flow causes:

droplets moving along one of said first and second paths to reach a medium to be printed upon; and droplets moving along the other of said first and second paths to by prevented from reaching the medium.

4. An apparatus as set forth in claim 1 further comprising:

an ink catcher positioned to allow droplets moving along said first path to move unobstructed past the catcher, while intercepting droplets moving along said second path.

5. A print head for printing an image, said print head comprising:

one or more nozzles from which a stream of ink droplets is emitted, the stream of ink droplets from each of the one or ore nozzles ejected along an initial axis, the droplets having adjustable ink velocities;

a mechanism, associated with each nozzle, adapted to independently adjust the velocity of the ink droplets emitted by the associated nozzle, said mechanism having:

a first state wherein the velocities of the droplets emitted from the nozzles are within a first range of velocities, and a second state wherein the velocities of the droplets emitted from the nozzles are within a second range of velocities, wherein velocities within said second range are greater than velocities within said first range; and a gas flow directed to intersect the initial axis to cause:

ink droplets within said first range of velocities to move along a first path, and ink droplets within said second range of velocities to move along a second path wherein the mechanism for droplet formation is a thermal actuator associated with each nozzle.

6. An apparatus for printing an image, said apparatus comprising:

a print head having:

one or more nozzles from which a stream ink droplets are emitted, and a mechanism, associated with each nozzle, adapted to independently adjust the velocity of the ink droplets emitted by the associated nozzle, said mechanism having:

a first state wherein the velocities of the droplets emitted from the nozzles are within a first range of velocities, and a second state wherein the velocities of the droplets emitted from the nozzles are within a second range of velocities, wherein velocities within said second range are greater than velocities within said first range; and a droplet deflector adapted to produce a force on the emitted droplets, said force being applied to the droplets at an angle with respect to said stream of ink droplets to cause:

ink droplets within said first range of velocities to move along a first path, and ink droplets within said second range of velocities to move along a second path.

7. An apparatus as set forth in claim 6 further comprising an ink catcher positioned to allow droplets moving along said first path to move unobstructed past the catcher, while intercepting droplets moving along said second path.

8. An apparatus as set forth in claim 6 wherein the droplet deflector comprises a gas flow.

9. A process for printing an image using one or more nozzles from which a stream of ink droplets is emitted by adjusting ink droplet velocities, the stream of ink droplets emitted along a nozzle axis; the process comprising:

independently adjusting the velocity of the ink droplets emitted by an associated nozzle such as to create a set of droplets emitted from the nozzles which are within a first range of velocities, and a set of droplets emitted from the nozzles which are within a first range of velocities, wherein velocities within said second range are greater than velocities within said first range; and directing a gas flow to intersect the stream of ink droplets, thereby causing ink droplets within said first range of velocities to move along a first path, and ink droplets within said second range of velocities to move along a second path.

10. A process as set forth in claim 9 wherein the gas flow is generally perpendicular to the nozzle axis.

11. A process as set forth in claim 9 further comprising allowing droplets moving along said first path to move unobstructed past an ink droplet catcher, while intercepting droplets moving along said second path.

* * * * *